United States Patent [19]

Kao

[11] 4,172,330

[45] Oct. 30, 1979

[54] SANDAL WITH REMOVABLE STRAP

[76] Inventor: Shane Kao, 822 B E. Acacia Ave., Glendale, Calif. 91205

[21] Appl. No.: 921,828

[22] Filed: Jul. 3, 1978

[51] Int. Cl.[2] ..... A43B 3/12; A43B 3/24

[52] U.S. Cl. ..... 36/11.5; 36/101

[58] Field of Search ..... 36/11.5, 100, 101, 50

[56] References Cited

U.S. PATENT DOCUMENTS

| | | | |
|---|---|---|---|
| 2,976,623 | 3/1961 | Gallaway | 36/11.5 |
| 3,121,962 | 2/1964 | Gullo | 36/11.5 |
| 3,204,346 | 9/1965 | Lockard et al. | 36/101 |
| 3,983,642 | 10/1976 | Liao | 36/101 |

*Primary Examiner*—Patrick D. Lawson

*Attorney, Agent, or Firm*—Charles H. Schwartz

[57] ABSTRACT

A sandal with removable straps including a platform having a top surface, a bottom surface and a side surface extending around the platform, the platform including a plurality of openings each extending from the top surface to the bottom or side surface, a plurality of recesses complementary in number to the plurality of openings and with each recess surrounding the end of each opening in the bottom or side surface, a removable strap member having loop portions at the ends of the strap member and with the ends of the strap extending through the openings from the top surface and with the loop portions lying within the recesses, and a plurality of button members complementary in number to the plurality of recesses and with each button member including means for locking the loop portions within the recesses and with each button member having a size and shape to substantially fill its recess.

10 Claims, 10 Drawing Figures

Fig. 6
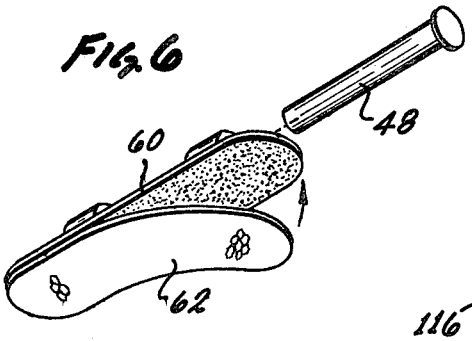
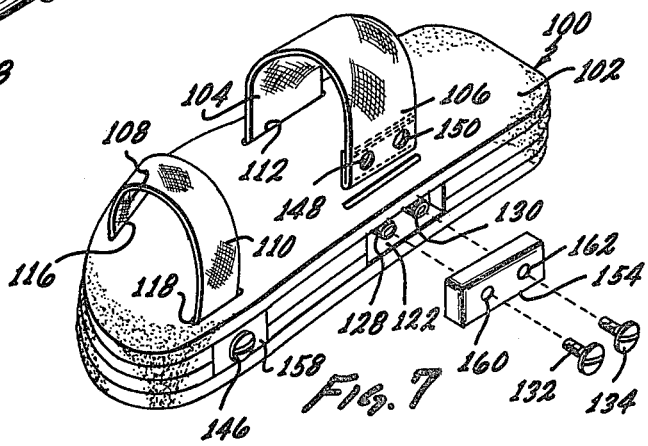
Fig. 7
Fig. 8
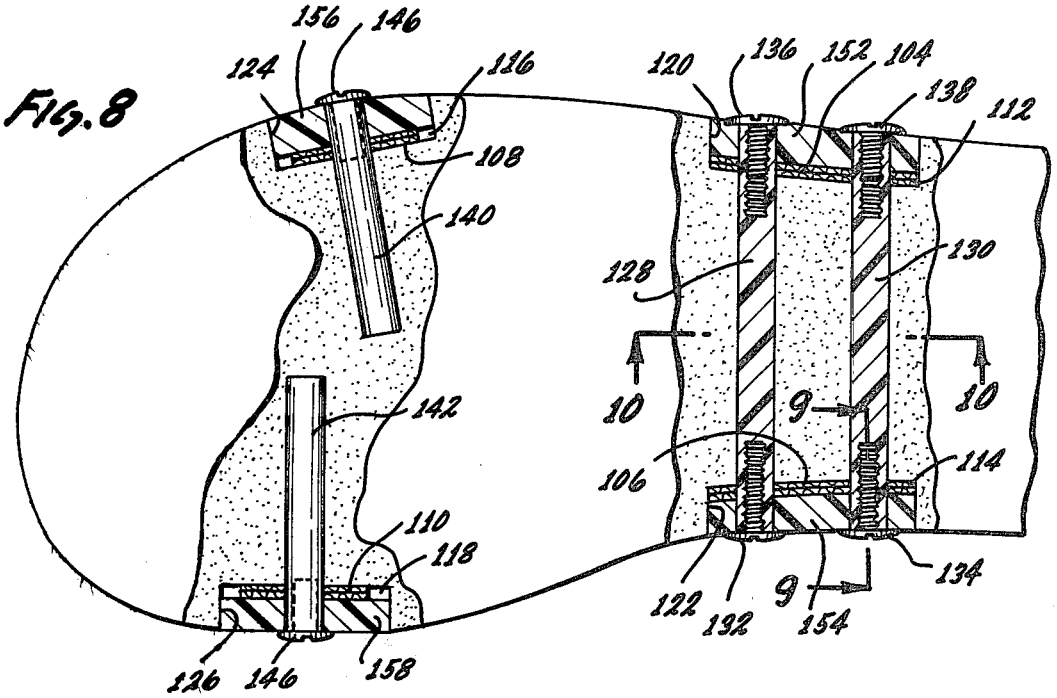
Fig. 9
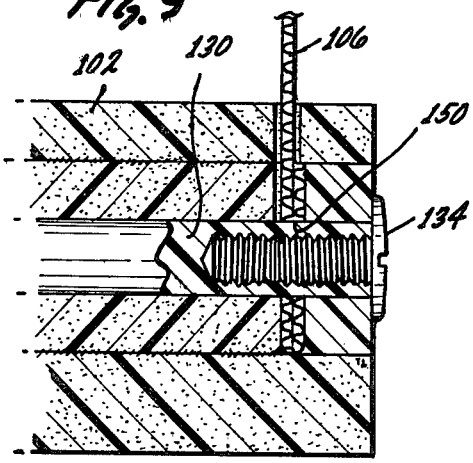
Fig. 10
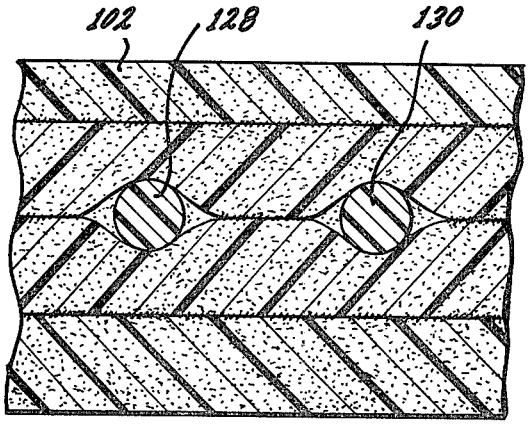

SANDAL WITH REMOVABLE STRAP

The present invention is directed to a sandal with removable strap. Specifically, the present invention is directed to a sandal formed from a platform and with at least one strap having end portions passing through openings in the top surface of the platform and with the openings extending through the platform to another surface of the platform. For example, the openings may pass downwardly through the platform to the bottom surface of the platform or downwardly and outwardly to the side surface of the platform. Recesses are provided either in the bottom surface of the platform or the side surface of the platform and with the recesses surrounding the openings. The ends of the strap are formed as loop portions and with button means and pin member contained within the recesses for locking the ends of the strap within the recesses and with the buttons closing off the recesses.

In one embodiment of the invention, the pin member passes through the loop portion at the end of the strap and interlocks with openings in the button member and with the pin member lying across the recess. In another embodiment of the invention, the pin member extends outwardly into the recess and the loop fits over the pin member and the button fits over the pin member and the loop to lock the end of the strap in position within the recess.

Conventional foot sandals ordinarily include a platform and with straps extending across the platform and permanently secured within the platform structure. The foot is then slipped into the strap so as to provide for a means of holding the foot to the platform. Typically, the platform is constructed of a plurality of elements forming a sandwich and with the ends of the straps locked within this sandwich construction and with this locking occurring during the manufacture of the sandal. The strap is therefore not removable and if the strap breaks or the strap becomes soiled, the sandal is often not usable, even though the platform may still be capable of a great amount of additional wear.

It has been proposed in the past to manufacture sandals and shoes with interchangeable and removable elements, but these prior art devices are normally quite complicated and difficult to provide for the interlocking of the elements. The present invention provides for a sandal structure which is very simple and provides for removable and replaceable straps which is simpler in construction and less expensive than prior art devices. In addition, the present invention provides for hiding the ends of the straps within recesses within the platform and for locking the ends of the strap within the recesses and for filling the recesses with a button member. The button member additionally operates to lock the ends of the strap within the recesses.

Specifically, the present invention provides in a first embodiment an opening in the platform which extends from the top surface of the platform to the bottom surface of the platform. The area surrounding the opening in the bottom surface of the platform is recessed and with the strap passing through the opening from the top surface to the bottom surface and with the end of the strap formed with a loop portion and which loop portion is contained within the recess. A button member fits within and closes off the recess and with a pin member passing through spaced axially aligned openings in the button and through the loop portion to lock the strap to the button member. The button member in addition to securing the end of the strap also closes off the recess to provide for a flush continuous surface at the bottom surface of the platform.

In a second embodiment of the invention, an opening passes from the top surface of the platform and extends downwardly and outwardly to the side surface of the platform. A recess is formed surrounding the opening in the side surface of the platform and with at least one pin member extending outwardly from an interior portion of the platform to have the end of the pin member lie within the recess. The end of the strap has a loop portion and with the loop portion positioned over the pin member. A button member then fills in the recess and includes an opening to receive the pin member so as to secure the end of the strap in position. In a specific example of the second embodiment of the invention, the end of the pin member is formed as a tubular portion having an interior thread and with a screw member threaded into the pin member so as to lock the button member in position and thereby lock the end of the strap.

A clearer understanding of the invention will be had with reference to the following description and drawings wherein FIG. 1 illustrates a front perspective view of a first embodiment of a sandal with removable strap;

FIG. 6 illustrates an alternative construction for the button used with the first embodiment of the invention;

FIG. 7 illustrates a front perspective view of a second embodiment of a sandal with removable strap;

FIG. 8 illustrates a top partially broken-away view of the second embodiment of the sandal;

FIG. 9 illustrates a cross-sectional view taken along lines 9—9 of FIG. 8; and FIG. 10 illustrates a cross-sectional view taken along lines 10—10 of FIG. 8.

Figure 1:
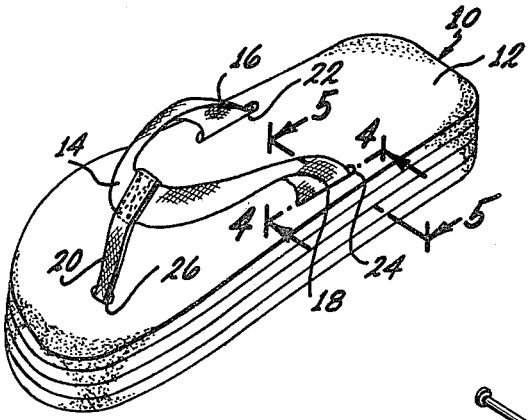

In FIG. 1 a first embodiment of a sandal 10 with removable strap is shown. The sandal 10 includes a platform 12 which platform 12 is shown to be constructed of a plurality of stacked elements which are glued together to form the unitary platform. It is to be appreciated that the platform could be also constructed of a single piece of material.

The strap member 14 includes three end portions 16, 18 and 20. As can be seen, the strap forms a member for passing across the front of the foot and with the portion 20 passing between the toes of the foot.

Figure 2:
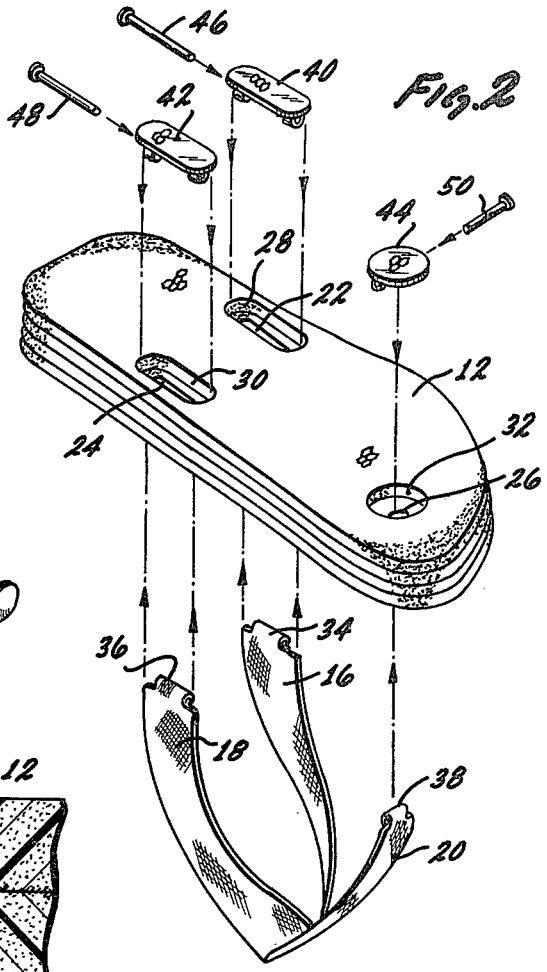
FIG. 2 illustrates a bottom exploded view of the first embodiment of the sandal with removable strap.

The ends 16, 18 and 20 of the strap 14 pass through openings 22, 24 and 26 in the top surface of the platform 12. These openings 22, 24 and 26 pass completely through the platform 12 and as shown in FIG. 2 terminate in recesses 28, 30 and 32 formed in the bottom surface of the platform 12. Also as shown in FIG. 2, the ends 16, 18 and 20 of the strap include loop portions 34, 36 and 38. The loop portions actually pass through the openings 22, 24 and 26 as shown in FIG. 1 so as to lie within the recesses 82, 30 and 32.

Figure 3:
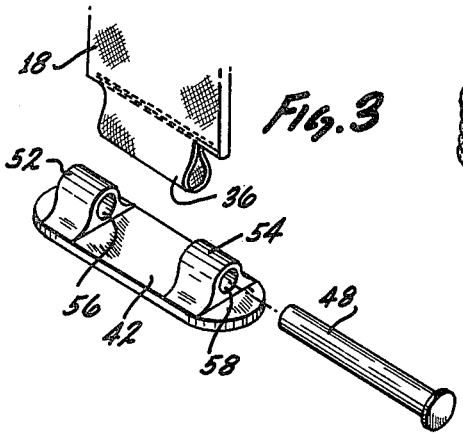
FIG. 3 illustrates a detail of a button for securing the end of the strap.

A plurality of button members 40, 42 and 44 are used to secure the ends of the straps and specifically the loop portions within the recesses. Pin members 46, 48 and 50 lock the buttons to the loops. This is shown in more detail in FIG. 3 wherein the end of the strap 18 is shown to include the loop portion 36. The button 42 includes spaced ears 52 and 54 which ears have axially aligned openings 56 and 58. The pin member 48 passes through the openings and also through the loop portion 36 located between the openings. This locks the end of the strap 18 within the recess in the bottom surface of the platform 12. The other button members 40 and 44 are similarly constructed so as to lock the respective ends of the strap in position.

The strap may be removed by prying the buttons away from the bottom surface of the platform 12 and out of the recesses thereby pulling the ends of the strap through the openings. The pins may then be slid out so as to free the ends of the strap so that the strap can then be pulled out of the openings through the upper surface of the platform 12. Similarly, a new strap may be inserted by pushing the ends of the strap through the openings in the upper surface of the platform until the ends of the strap pass into the recesses in the bottom surface of the platform. The buttons may then be locked to the ends of the straps using the pins and with the buttons then pushed into the recesses so as to close off the recesses.

Figure 4:
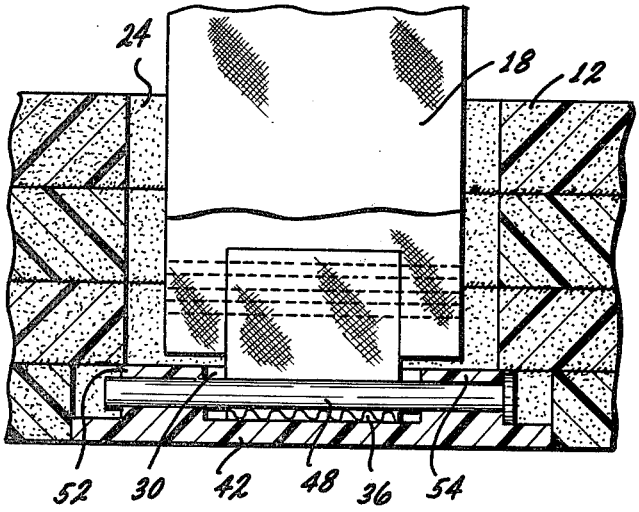
FIG. 4 illustrates a cross-sectional view taken along lines 4—4 of FIG. 1.
Figure 5:
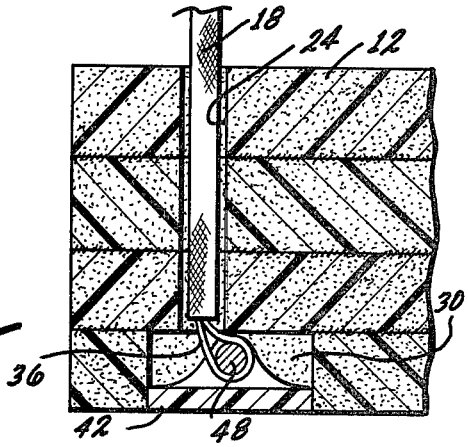
FIG. 5 illustrates a cross-sectional view taken along lines 5—5 of FIG. 1.

This may be more clearly shown with reference to the cross-sectional views of the first embodiment of the sandal shown in FIGS. 4 and 5. In FIG. 4 and 5 it can be seen that each button, and in particular using button 42 as an exemplar, locks the end of the strap in position and with this locking occurring within the recess. Once the button is secured in position, the bottom surface of the platform presents a flush continuous exterior surface so as to disguise the fact that the strap is removable. Moreover, the flush surface does not provide any impediment to the use of the sandal.

In the structure of the first embodiment of the invention as shown in FIGS. 1 through 5, each button is illustrated to be a unitary member. FIG. 6 illustrates an alternative for this button structure wherein the button is constructed as a two-piece member. The two-piece button includes a first rigid portion 60 which is used in conjunction with the pin 48 to lock the end of the strap. A second resilient portion 62 is cremented to the rigid portion 60 and the resilient portion 62 may be constructed of the same material as the bottom surface of the platform 12 of the sandal 10. In this way, the bottom surface of the sandal is all of the same material.

FIGS. 7 through 10 illustrate a second embodiment of the invention and show a sandal 100 which includes two removable straps. In particular, the second embodiment of the invention includes a platform 102 and a pair of straps having end portions 104, 106, 108 and 110. The ends of the straps are inserted into openings 112, 114, 116 and 118 which openings are through the top surface of the platform 102 and extend downwardly and outwardly to terminate in recesses 120, 122, 124 and 126 in the side wall of the platform 102. A plurality of pin members extend from within the interior portion of the platform 102 and have end portions which project into the recesses. As shown in FIG. 8, pin members 128 and 130 extend between the recesses 120 and 122. The ends of the pin members 128 and 130 include interior threaded portions to receive screws 132 through 138.

A pair of single pin members 140 and 142 extend from the interior of the platform 102 and have end portions which terminate in recesses 124 and 126. The ends of the pin members 140 and 142 are similarly threaded to receive screws 144 and 146.

As shown in FIG. 7 and using the end 106 of one of the straps, the end of the strap includes openings 148 and 150 which form a pair of loop portions and with the loop portions positioned to pass over and be locked in position by the pins 128 and 130. The end 104 of the one strap also includes similar loop portions and the ends 108 and 110 of the other strap each include a single loop portion to lock around the single pins 140 and 142.

A plurality of button members 152, 154, 156 and 158 are used to fill in the recesses in the sidewall of the platform 102 and to lock the ends of the straps in position over the pin members. As shown in FIG. 1, the button members include openings 160 and 162 so that the button member and, in particular, as shown in FIG. 1, the button member 154 can pass over the pin after the loop portions at the end of the strap has been placed in position with the loops over the pins and with the screws 132 and 134 locking the button in position. It is to be appreciated that button members such as shown in FIGS. 1 through 6 may be used in place of the structure shown in the second embodiment of the invention and that also other forms of button members and other means for locking the button members in position may be used.

It can be seen that the present invention is therefore directed to a sandal with removable strap having the ends of the strap pass through openings in the top surface of a platform and with the ends of the strap including loop portions and with the loop portions of the strap positioned within recesses in a surface of the platform other than the top surface. Button members are positioned within the recesses so as to lock the loop portions of the strap in position and to also fill in the recesses and thereby provide for a relatively smooth exterior surface for the platform of the sandal.

Although the invention has been described with reference to particular embodiments, it is to be appreciated that various adaptations and modifications may be made and the invention is only to be limited by the appended claims.

I claim:

1. A sandal with removable straps including a platform having a top surface, a bottom surface and a side surface extending around the platform, the platform including a plurality of openings each extending from the top surface to the bottom or side surface, a plurality of recesses complementary in number to the plurality of openings and with each recess surrounding the end of each opening in the bottom or side surface, a removable strap member having loop portions at the ends of the strap member and with the ends of the strap extending through the openings from the top surface and with the loop portions lying within the recesses, and a plurality of button members complementary in number to the plurality of recesses and with each button member including means for locking the loop portions within the recesses and with each button member having a size and shape to substantially fill its recess.

2. The sandal of claim 1 wherein the openings each extend from the top surface to the bottom surface and the buttons fill the recesses and provide a continuous bottom surface for the platform.

3. The sandal of claim 2 wherein the bottom members include an outside surface material to match the bottom surface for the platform.

4. The sandal of claim 1 wherein the openings each extend from the top surface to the side surface.

5. The sandal of claim 1 additionally including pin members passing through the loop portions and with the button members interlocking with the pin members.

6. The sandal of claim 5 wherein each button members includes at least one opening to receive a portion of one of the pin members.

7. The sandal of claim 6 wherein the pin members extend across the recesses and pass through the at least one opening in the button members and through the loop portions.

8. The sandal of claim 7 wherein the button members include two spaced openings along the same axis and with the loop portions positioned between the two spaced openings and with the pin members passing through the spaced openings and the loop portions and locking the loop portions between the spaced openings.

9. The sandal of claim 6 wherein the pin members extend outwardly from the interior of the platform to have end portions lying within the recesses and with the loop portions passing over the end portions and with the openings in the buttons passing over the end portions.

10. The sandal of claim 9 wherein the end portions of the pin members including threaded openings and additionally including screw members threaded into the threaded openings to lock the button members and loop portions within the recesses.

* * * * *